United States Patent [19]

Forrester et al.

[11] 4,146,766

[45] Mar. 27, 1979

[54] ACTUATING MECHANISMS FOR VACUUM INTERRUPTERS

[75] Inventors: Jack T. Forrester, Manchester; John Lowe, Dukinfield, both of England

[73] Assignee: Associated Electrical Industries Limited, London, England

[21] Appl. No.: 790,334

[22] Filed: Apr. 25, 1977

[51] Int. Cl.[2] ..... H01H 3/46

[52] U.S. Cl. ..... 200/153 G; 200/48 R; 200/337; 200/DIG. 42

[58] Field of Search ..... 200/DIG. 42, 153 G, 200/337, 329, 48 R

[56] References Cited

U.S. PATENT DOCUMENTS

| | | | |
|---|---|---|---|
| 3,527,910 | 9/1970 | Mitchell, Jr. et al. | 200/153 G |
| 3,562,454 | 2/1971 | Chance | 200/153 G |
| 3,852,553 | 12/1974 | Lingenfelter et al. | 200/153 G |
| 3,867,598 | 2/1975 | Richards et al. | 200/153 G |

*Primary Examiner*—William D. Martin, Jr.

*Attorney, Agent, or Firm*—Kirschstein, Kirschstein, Ottinger & Cobrin

[57] ABSTRACT

An actuating mechanism for a vacuum interrupter incorporates a pivotable bell crank mechanism and a displacement structure for imparting movement of the bell crank mechanism to a coupling structure which is connectable to a contact stem carrying the movable contact of the interrupter for moving the contact into and out of engagement with another contact of the interrupter. After movement of the coupling structure for a sufficient distance in a direction which causes closure of the contacts the displacement structure is capable of being moved for a further distance to disengage it from a cooperating surface of the coupling structure. On the return movement the displacement structure is traveling at high velocity when it re-engages the cooperating surface of the coupling structure which produces a rapid acceleration of the latter and hence, in use, of the movable contact of the interrupter to the open position.

4 Claims, 4 Drawing Figures

ACTUATING MECHANISMS FOR VACUUM INTERRUPTERS

This invention relates to actuating mechanisms for vacuum interrupters, that is to say electrical devices incorporating within an evacuated envelope a pair of electrical contacts, one of which is movable into and out of engagement with the other, to make or break an electrical circuit. The movable contact is usually supported by a conducting stem extending outwards through a flexible part of the envelope, commonly in the form of a diaphragm or bellows, and in order to effect the required movement of the contact to an open or closed position the outer end of the stem is arranged to be coupled, either directly or indirectly, to a suitable actuating mechanism.

An object of the invention is to provide a particularly advantageous actuating mechanism for such vacuum interrupters.

According to the invention an actuating mechanism for a vacuum interrupter comprises a first structure connectable to the outer end of the contact stem carrying the movable contact of the interrupter, a second structure movable relative to the first structure and engageable with a co-operating surface of the first structure for urging the movable contact away from the other contact of the interrupter, and operating means operable to displace the second structure towards the interrupter so that it moves the first structure and causes the movable contact to engage the said other contact, and causes the second structure subsequently to disengage from the co-operating surface of the first structure.

By arranging for the second structure to move a sufficient distance to disengage from the co-operating surface of the first structure after closure of the interrupter contacts, there is provided a stored energy pick-up of the latter, which ensures severance of weld spots, on the opening stroke and a more rapid acceleration of the movable contact, to the open position.

Preferably the second structure is biassed away from the first structure by suitable spring means, such as one or more springs which are compressed when the second structure is displaced towards the interrupter, to cause a rapid return movement of the second structure when the interrupter contacts are required to be opened.

The first structure of the actuating mechanism may comprise a threaded member arranged to screw on to the contact stem carrying the movable contact of the vacuum interrupter and provided with studs which enable it to be clamped to a plate which provides the co-operating surface. The second structure may comprise one or more eye bolts which extend through apertures in the plate and carry nuts which engage the co-operating surface. The spring means may comprise compression springs fitted over the shanks of the eye bolts and interposed between the heads of the eye bolts and the plate.

The operating means may comprise a bell crank mechanism operable to displace the second structure towards the interrupter so that it moves the first structure and causes the movable contact to engage the other contact. The bell crank mechanism may be provided with a spring arrangement adapted to urge the contacts of the vacuum interrupter towards the open position and having a toggle action which provides the greatest effect when the contacts are in the open position and the least effect when the contacts are in the closed position.

The invention will now be described, by way of example, with reference to the accompanying drawings in which.

Figure 1:
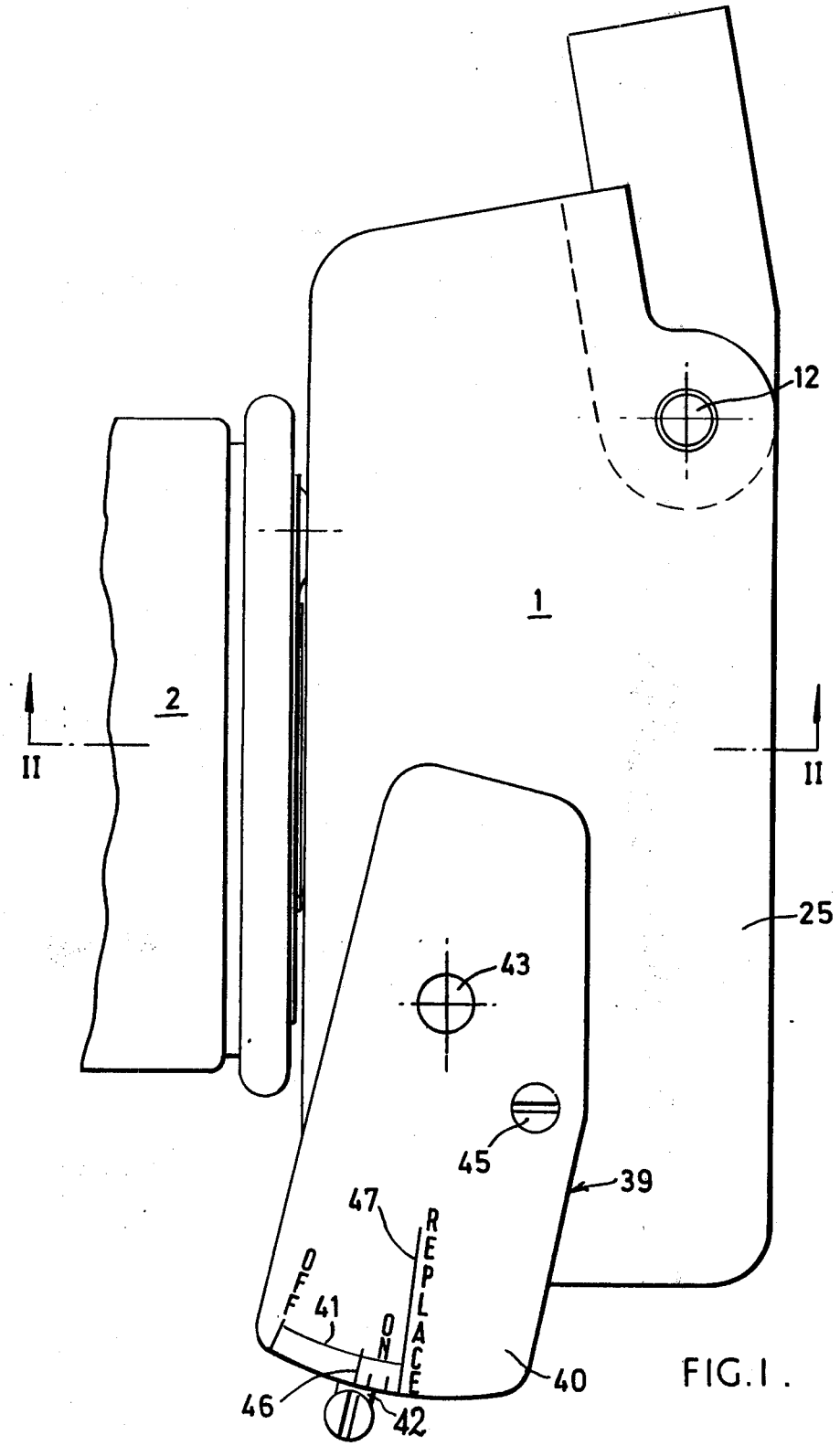
FIG. 1 is a side elevation of an actuating mechanism in accordance with the invention.

Referring to the drawings, the actuating mechanism of the invention is accommodated in a generally rectangular housing 1 of non-ferrous material which also forms a mounting for a vacuum interrupter 2 to be actuated by the mechanism. The vacuum interrupter 2 is secured to a rear wall 3 of the housing 1 by a nut 4 screwed on a threaded stem 5 projecting from an end plate 6 of the vacuum interrupter so that the movable contact stem 7 of the vacuum interrupter projects through an aperture 8 in the rear wall 3.

The actuating mechanism comprises two bell crank levers 9 having two relatively inclined arms 10 and 11 arranged parallel to each other and mounted on a common spindle 12 journalled in the housing 1. The arms 10 of the two bell crank levers 9 are coupled together at their lower ends by a pin 13 which extends transversely of and passes through the two arms 10. Another pin 14 extends transversely of and couples together the upper ends of the arms 11 of the two bell crank levers 9, while a further pin 15 passes through and couple together the arms 11 intermediate the spindle 12 and their lower ends.

The pin 15 is coupled to an operating plate 16 by two eye bolts 17, the shanks 18 of which are arranged to slide in guides 19 in the operating plate 16. Two helical compression springs 20 fitted over the shanks 18 of the eye bolts 17 are interposed between the heads of the eye bolts and a recess in the operating plate 16. Two further eye bolts 21 mounted on the outer ends of the pin 13 have their shanks 22 arranged to slide in guides in a bridge member 23 which is pivotally mounted between headed pins 24 extending through the side walls 25 of the housing 1. Two helical compression springs 26, which are fitted over respective shanks 22 of the eye bolts 21, are interposed between the heads of the eye bolts and the bridge member 23.

The operating plate 16 is connected to the movable contact stem 7 by a threaded nut 27 which screws on to the stem 7 of the vacuum interrupter 2 and carries four studs 28 provided with co-operating nuts 29. The four studs 28 extend through holes in the operating plate 16 and through corresponding holes in one limb 30 of a U-shaped bracket 31, the nuts 29 being tightened on the studs 28 to electrically and mechanically connect the operating plate 16 and the bracket 31 to the movable contact stem 7. A spring washer 32 may be fitted between the operating plate 16 and the bracket 31. A block 33 provided with a projecting stem 34 is secured to the central part of the pin 15 so that the stem 34 is located in an aperture 35 in the limb 36 of the bracket 31 when the actuating mechanism and the contacts (not shown) of vacuum interrupter 2 are in the fully closed position. The relative positions of the stem 34 and the aperture 35 provide a convenient arrangement for checking the fully closed position of the actuating mechanism during assembly.

The operating plate 16 is electrically connected by laminated flexible conductors 37 to a clamp 38 provided at the top of the housing 1. The clamp is arranged to form a mechanical and electrical connection to an electrically conductive stem (not shown) of an electrical circuit breaker of which the actuating mechanism and vacuum interrupter 2 form part. In a modified arrangement the laminated flexible conductors 37 may be replaced by a sliding contact in the form of a multi-fingered tubular connection between spherical contacts provided on the clamp 38 and the operating plate 16, or in the form of a series of fingers side by side engaging flat contacts.

An indicator 39 which is arranged to monitor the erosion of the contacts of the vacuum interrupter 2 comprises a plate 40 inscribed with a graduated scale 41 and a pointer 42 arranged to co-operate with the scale. The pointer 42 is pivotally mounted on a pin 43 secured in the side wall 25 of the housing and is coupled to the movable contact of the vacuum interrupter through the operating plate 16 and the movable contact stem 7. To this end the upper end of the pointer 42 is bifurcated to receive a pin 44, so that linear movement of the movable contact of the vacuum interrupter 2 produces a pivotal movement of the lower end of the pointer 42 along the scale 41. The plate 40, which is also pivotally mounted on the pin 43, is arranged to be rigidly clamped to the side 25 of the housing 1 by a screw 45, the pivotal movement of the plate 40 being arranged to provide adjustment of the position of the scale 41 to cater for manufacturing tolerances in the parts of the actuating mechanism or the vacuum interrupter 2.

Figure 3:
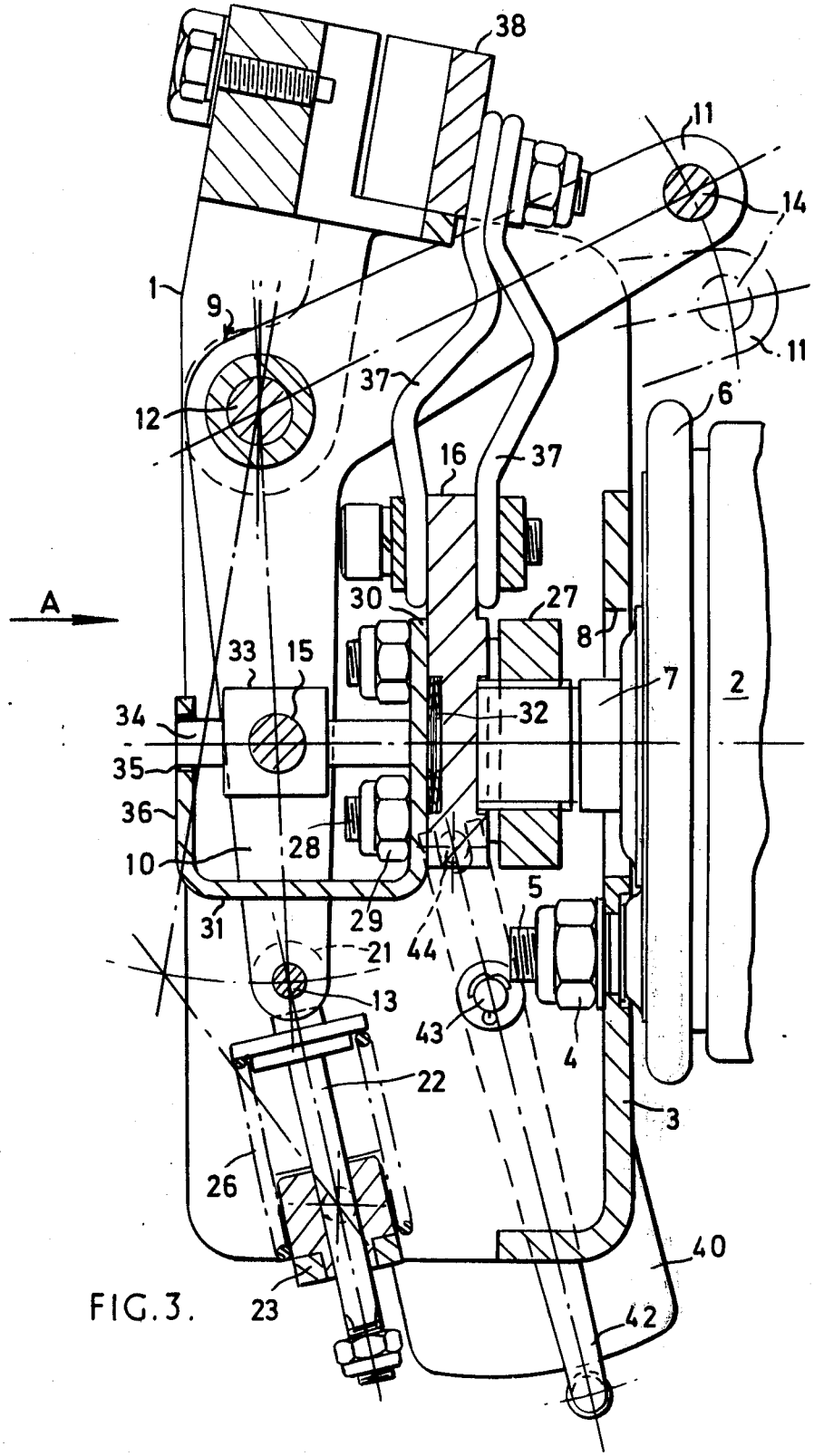
FIG. 3 is a side elevation, partly in section, of the actuating mechanism shown in FIG. 1, but looking from the opposite side.
Figure 4:
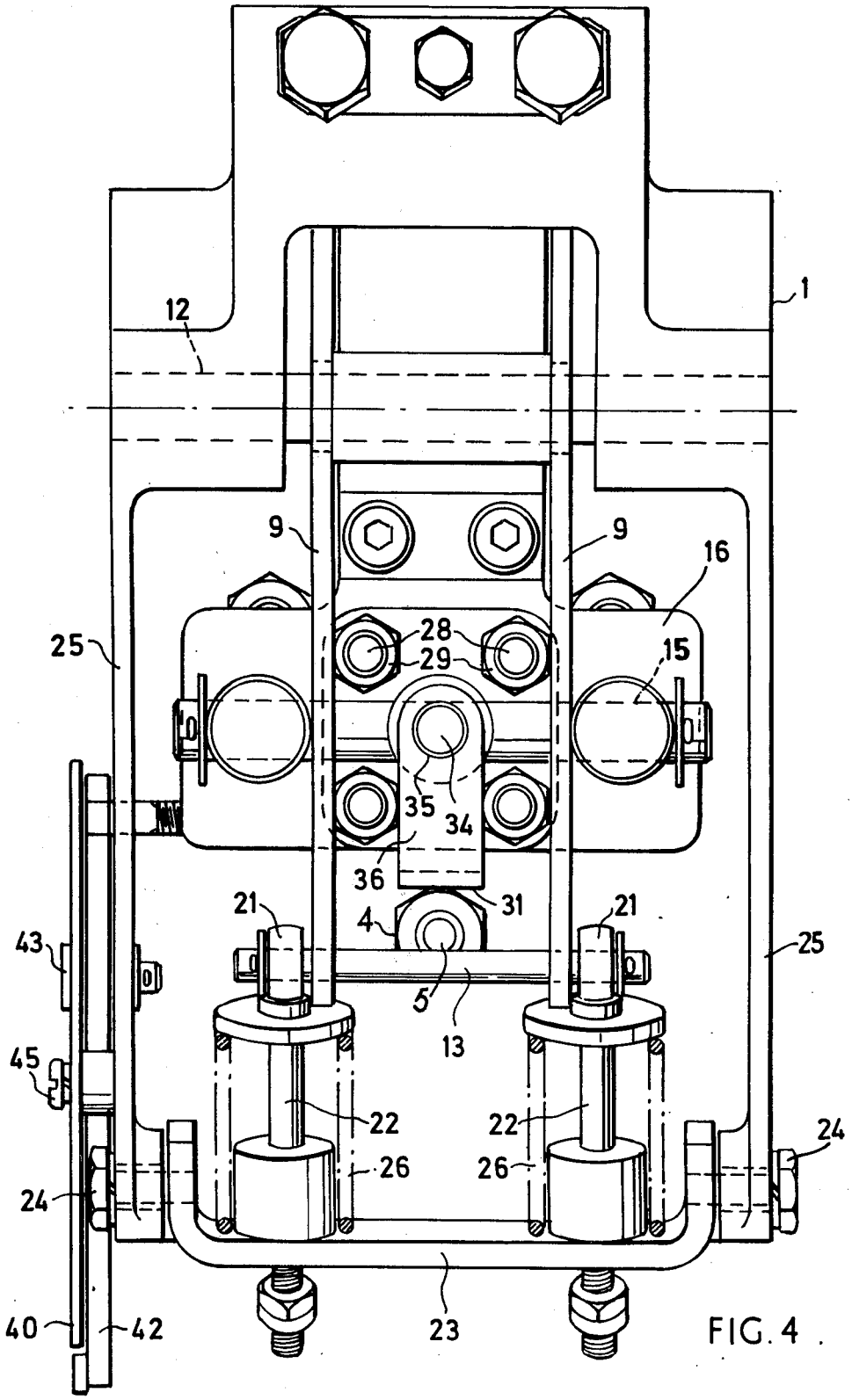
FIG. 4 is an end elevation of the actuating mechanism looking in the direction of the arrow A in FIG. 3.

In the Figures, the parts of the actuating mechanism are shown in positions in which the contacts of the vacuum interrupter 2 are closed, the ends of the arms 11 of the bell crank levers 9 having been previously moved upwards from the position shown in broken line to the position shown in full line in FIG. 3, to effect closing of the contacts. Conveniently, a link on a switch closing mechanism (not shown) is arranged to impart an upward movement to the pin 14 to effect closing of the vacuum interrupter contacts. The vacuum interrupter contacts are held in the closed position by the link of the switch closing mechanism so that the springs 20 and 26 are compressed and the pointer 42 takes up a position on the scale 41. When the vacuum interrupter 2 is new and its contacts are not eroded, the pointer 42 will lie adjacent the line 46, as seen in FIG. 1, but will move to the right of this line as erosion of the contacts increases. If the pointer 42 moves beyond the line 47 it indicates that the erosion of the contacts is such that the vacuum interrupter 2 needs to be replaced.

To open the contacts of the vacuum interrupter 2, a latch in the circuit breaker closing mechanism is moved away from the linkage connected to pin 14 so that the upper ends of the arms 11 of the bell crank levers 9 are urged downwards by the springs 20 and 26 towards the position shown in broken line. Initially, the springs 20 and 26 act together to cause the bell crank levers 9 to pivot about the spindle 12, but the operating plate 16 remains stationary until the nuts 48 on the shanks 18 of the eye bolts 17 engage a co-operating surface 49 of the operating plate 16. The impact of the nuts 48 on the co-operating surface 49 of the operating plate 16 is effective to break any welds between the contacts of the vacuum interrupter. After the contacts of the vacuum interrupter have separated the springs 20 are no longer effective and the further pivotal movement of the bell crank levers 9 and the movement of the operating plate 16 is provided by the springs 26. It will be appreciated that the manner in which springs 26 are mounted on the shanks 22 of the eye bolts 21, and the way the shanks 22 slide in guides in the pivoted bridge members 23, causes this arrangement to have a toggle action in which the springs 26 provide their greatest effect when the vacuum interrupter contacts are in the open position and their least effect when they are in the closed position. The springs 26 hold the vacuum interrupter contacts at rest, in the open position, with the correct spacing, against the atmospheric loading.

Figure 2:
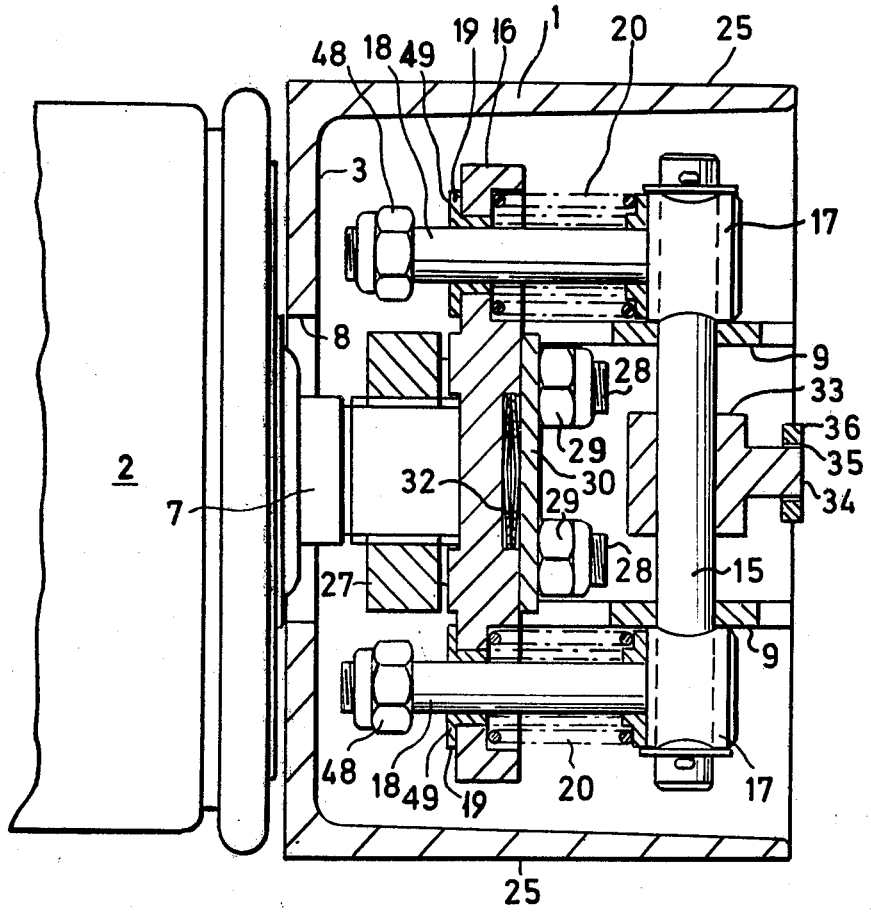
FIG. 2 is a section taken on the line II—II in FIG. 1 looking in the direction of the arrows.

To close the contacts of the vacuum interrupter 2 the link of the circuit breaker closing mechanism is caused to apply an upward pull to the pin 14, so that the bell crank levers 9 pivot about the spindle 12 and the pin 15 moves towards the vacuum interrupter. This movement of the pin 15 is imparted to the eye bolts 17 which apply pressure to the operating plate 16 through springs 20. The operating plate 16 moves the movable contact stem 7 which causes the movable contact of the vacuum interrupter 2 to engage the fixed contact. Further movement of the bell crank levers 9, the pin 15 and the eye bolts 17 compresses the springs 20 to increase the contact loading and also compresses the springs 26. Finally, the nuts 48 on the eye bolts 17 move away from the co-operating surface 49 of the operating plate 16 as shown in FIG. 2. This movement of the nuts 48 away from the co-operating surface 49 of the operating plate 16 is sufficient to maintain the necessary contact pressure throughout the life of the vacuum interrupter contacts. Typically a vacuum interrupter may have a contact gap of 8 mm. when new which may increase to 11 mm. when the contacts have been eroded to an extent when they are no longer suitable.

We claim:

1. In an actuating mechanism for a vacuum interrupter, said actuating mechanism comprising a coupling structure having means for connection to the outer end of a contact stem carrying the movable contact of the interrupter and displaceable through an operative distance in opposed first and second directions to cause the movable contact to move into and out of engagement with the other contact of the interrupter, that improvement wherein the actuating mechanism further comprises:

(A) a bell crank mechanism mounted for pivoting movement about an axis transverse to the direction of movement of the coupling structure, and (B) a displacement structure movable under the action of the bell crank mechanism, (C) the bell crank mechanism being pivotable in a first sense for causing the displacement structure to engage a cooperating surface of the coupling structure and urge the latter through said operative distance in said second direction, (D) the bell crank mechanism also being pivotable in the reverse sense for causing the displacement structure first to displace the coupling structure through said operative distance in the said first direction, and subsequently to disengage from the cooperating surface of the coupling structure, and (E) a spring means acting on an arm of the bell crank mechanism to urge it in said first sense, the spring means having a toggle action which provides the greatest effect when the bell crank mechanism has been pivoted fully in said first sense and the least effect when the bell crank mechanism has been pivoted fully in the reverse sense.

2. An improvement for an actuating mechanism as claimed in claim 1 having means for indicating the extent of movement of the displacement structure when the coupling member has been moved in the first direction.

3. An improvement for an actuating mechanism as claimed in claim 2 wherein the indicating means includes a stem movable by the displacement structure so as to be located relative to a member carried by the coupling structure.

4. An improvement for an actuating mechanism as claimed in claim 1 having a pointer coupled to the coupling structure and a scale across which the pointer moves on movement of the coupling structure.

* * * * *